US009372018B2

(12) United States Patent
Barone et al.

(10) Patent No.: US 9,372,018 B2
(45) Date of Patent: Jun. 21, 2016

(54) EVAPORATOR HEAT EXCHANGER

(71) Applicant: HAMILTON SUNDSTRAND CORPORATION, Windsor Locks, CT (US)

(72) Inventors: Michael R. Barone, Amston, CT (US); Richard Rusich, Ellington, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 221 days.

(21) Appl. No.: 13/910,667

(22) Filed: Jun. 5, 2013

(65) Prior Publication Data

US 2014/0360224 A1 Dec. 11, 2014

(51) Int. Cl.

| | |
|---|---|
| ***F25B 39/02*** | (2006.01) |
| ***F28F 3/04*** | (2006.01) |
| ***F28F 9/02*** | (2006.01) |
| ***F28D 9/00*** | (2006.01) |
| *F28D 21/00* | (2006.01) |

(52) U.S. Cl.

CPC ..... *F25B 39/022* (2013.01); *F28D 9/005* (2013.01); *F28F 3/046* (2013.01); *F28F 9/0248* (2013.01); *F28D 2021/0021* (2013.01); *F28D 2021/0071* (2013.01)

(58) Field of Classification Search

CPC ..... F25D 39/022; F25D 39/02; F25B 39/022; F28F 3/046; F28F 9/0248; F28D 9/005; F28D 2021/0021; F28D 2021/0071

USPC ..... 62/515; 165/185

See application file for complete search history.

(56) References Cited

U.S. PATENT DOCUMENTS

| | | | | |
|---|---|---|---|---|
| 4,630,674 | A * | 12/1986 | Skoog | 165/147 |
| 5,481,886 | A * | 1/1996 | Hasegawa et al. | 62/285 |
| 5,638,899 | A * | 6/1997 | Blomgren et al. | 165/166 |
| 5,875,838 | A * | 3/1999 | Haselden | 165/146 |
| 6,532,755 | B2 * | 3/2003 | Ichikawa et al. | 62/228.3 |
| 6,691,428 | B1 * | 2/2004 | Zarif | 34/62 |
| 6,823,934 | B2 * | 11/2004 | Andersson | 165/167 |
| 7,775,264 | B2 * | 8/2010 | Andersson et al. | 165/167 |
| 8,544,294 | B2 * | 10/2013 | Garner | 62/476 |
| 2002/0134097 | A1 * | 9/2002 | Ichikawa et al. | 62/228.3 |
| 2003/0047303 | A1 * | 3/2003 | Andersson | 165/167 |
| 2003/0051501 | A1 * | 3/2003 | Matsushima et al. | 62/435 |
| 2004/0069473 | A1 * | 4/2004 | Blomgren et al. | 165/167 |
| 2005/0039898 | A1 * | 2/2005 | Wand et al. | 165/167 |
| 2006/0162916 | A1 * | 7/2006 | Wand et al. | 165/167 |
| 2008/0121379 | A1 * | 5/2008 | Bidon et al. | 165/110 |
| 2008/0283231 | A1 * | 11/2008 | Horte | 165/167 |
| 2009/0285956 | A1 * | 11/2009 | Landers et al. | 426/477 |
| 2010/0018616 | A1 * | 1/2010 | Eucken | 148/672 |
| 2010/0024448 | A1 * | 2/2010 | Critoph | 62/101 |
| 2010/0218927 | A1 * | 9/2010 | Cooper et al. | 165/185 |
| 2011/0072837 | A1 * | 3/2011 | Brown et al. | 62/115 |
| 2011/0083833 | A1 * | 4/2011 | Zorzin et al. | 165/166 |

(Continued)

*Primary Examiner* — Mohammad M Ali

(74) *Attorney, Agent, or Firm* — Cantor Colburn LLP

(57) ABSTRACT

An evaporator heat exchanger is disclosed. The evaporator heat exchanger includes a bottom plate, a top plate, and at least one main plate between the bottom plate and the top plate. The at least one main plate includes a first face having one or more channels for flow of a first fluid along the first face and a second face opposite the first face having one or more channels for flow of a second fluid along the second face, wherein heat is exchanged between the first fluid and the second fluid through the main plate. Main plates adjacent to each other define an enclosed channel for fluid flow.

7 Claims, 3 Drawing Sheets

(56) References Cited

U.S. PATENT DOCUMENTS

2011/0108258 A1* 5/2011 Magnier-Cathenod et al. ..... 165/170
2011/0209861 A1* 9/2011 Hayashi et al. ..... 165/185
2013/0014538 A1* 1/2013 Garner ..... 62/476

* cited by examiner

EVAPORATOR HEAT EXCHANGER

BACKGROUND

The present disclosure relates to heat exchangers, and more specifically, to an evaporator heat exchanger for use in aerospace applications.

Heat exchangers are used to cool fluids, such as fluids used in engines. One type of heat exchanger is the plate heat exchanger which includes multiple plates that are separated from each other. Plate heat exchangers are generally used in heating, venting and air-conditioning applications. The plates include fluid flow passages for heat transfer. Aerospace environments provide a number of challenges to the design of the plate heat exchanger.

SUMMARY

According to one embodiment of the present disclosure, an evaporator heat exchanger includes: a bottom plate; a top plate; and a main plate between the bottom plate and the top plate, wherein the main plate includes a first face having one or more channels for flow of a first fluid along the first face and a second face opposite the first face having one or more channels for flow of a second fluid along the second face, wherein heat is exchanged between the first fluid and the second fluid through the main plate.

According to another embodiment, a main plate of an evaporator heat exchanger includes: a first face having one or more channels for flow of a first fluid along the first face and a second face opposite the first face having one or more channels for flow of a second fluid along the second face, wherein heat is exchanged between the first fluid and the second fluid through the main plate.

According to another embodiment, an evaporator heat exchanger includes: a first main plate including a first face having a ridge and a trough for defining a first volume for flow of a fluid along the first face; and a second main plate including a second face having a ridge and a trough defining a second volume for flow of a fluid along the second face; wherein the first main plate and the second main plate are placed adjacent each other to define an enclosed channel for fluid flow from the first volume and the second volume.

Additional features and advantages are realized through the techniques of the present disclosure. Other embodiments and aspects of the disclosure are described in detail herein and are considered a part of the claimed disclosure. For a better understanding of the disclosure with the advantages and the features, refer to the description and to the drawings.

BRIEF DESCRIPTION OF THE SEVERAL VIEWS OF THE DRAWINGS

The subject matter which is regarded as the disclosure is particularly pointed out and distinctly claimed in the claims at the conclusion of the specification. The forgoing and other features, and advantages of the disclosure are apparent from the following detailed description taken in conjunction with the accompanying drawings in which:

DETAILED DESCRIPTION

Figure 1:
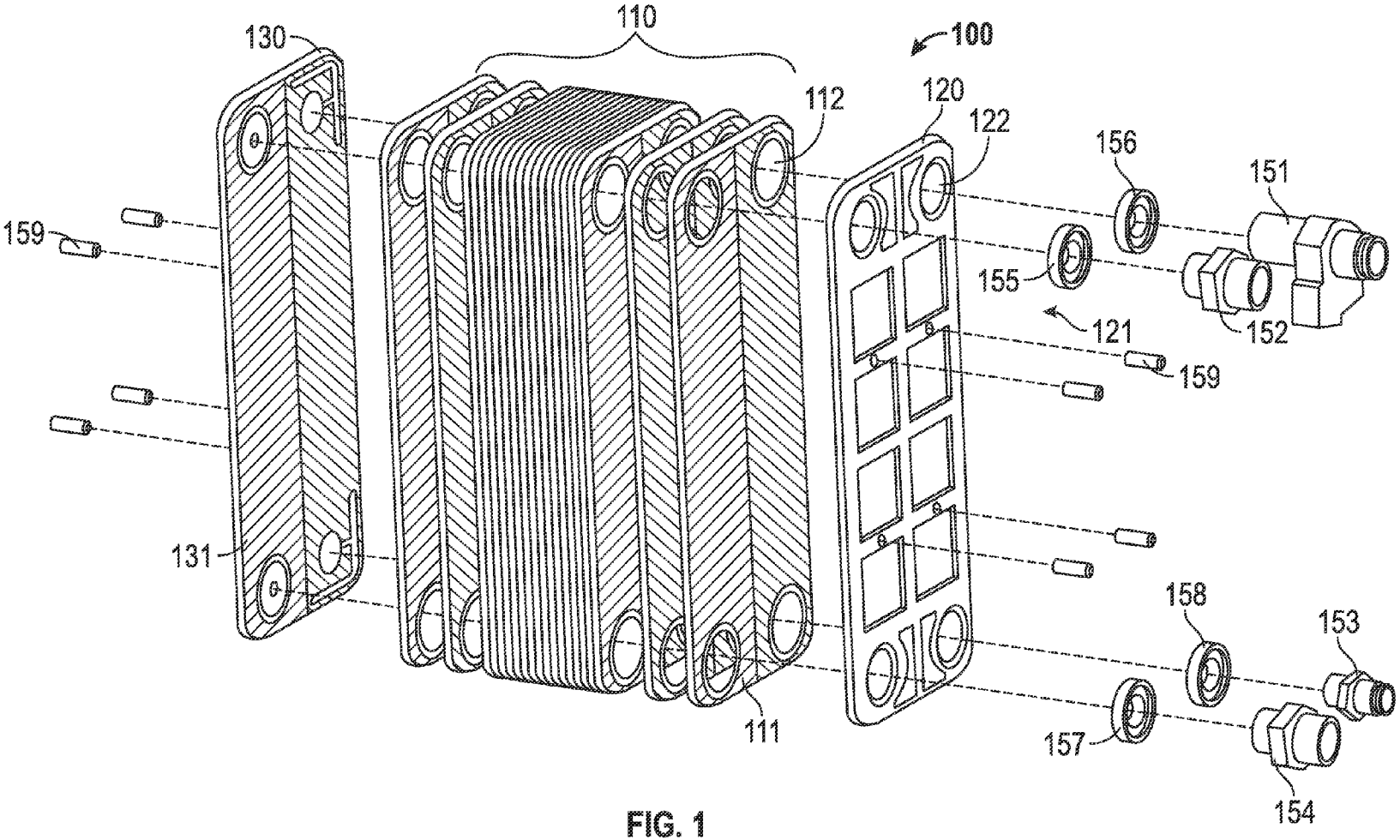
FIG. 1 is an exploded view of a plate heat exchanger 100 according to one embodiment.

FIG. 1 is an exploded view of a plate heat exchanger 100 according to one embodiment. The plate heat exchanger 100 includes main plates 110 having ridged regions 111 on one or more surfaces of the main plate 110 and openings 112 corresponding to inlets and outlets of a fluid. The ridged regions 111 may include ridges and troughs that form channels in the surface of the main plate 110 for fluid flow. The channels may be oriented to form a herringbone or chevron pattern to increase a surface area of the main plate 110 contacted by the fluid and to generate turbulence in the fluid. A direction of the herringbone pattern on one face of the main plate may be similar to the direction of the herringbone pattern on the opposite face of the main plate. Alternatively, the direction of the herringbone pattern on one face of the main plate may be inverted from the direction of the herringbone pattern on the opposite face of the main plate.

The openings 112 of the main plates may be provided, alternatingly, with protrusions or recesses surrounding the openings 112 to alternate a fluid that enters a cavity between the main plates. For example, a first fluid may enter first, third and fifth cavities between the main plates, and a second fluid may enter second, fourth and sixth cavities. The fluids are maintained separated from each other and exchange heat via heat conduction through the main plate 110 as they flow through the cavities.

The plate heat exchanger 100 includes a first end plate 120, also referred to herein as a top end plate 120. The plate heat exchanger 100 also includes a second end plate 130, also referred to herein as a bottom end plate 130. The top end plate 120 and bottom end plate 130 are positioned at opposite sides of the plurality of main plates 110. The illustrated top end plate 120 includes openings 122 to receive fluid fittings 151, 152, 153 and 154. A first fluid may be input to the plate heat exchanger 100 via a fluid fitting 151 and output from the heat exchanger via a fluid fitting 152. A second fluid may be input to the plate heat exchanger 100 via the fluid fitting 153 and output from the plate heat exchanger 100 via the fluid fitting 154. Weld stubs 155, 156, 157 and 158 may also be provided between a wide portion of the fluid fittings 151, 152, 153 and 154 and the top end plate 120.

FIG. 1 further shows the bottom end plate 130 including an inward-facing surface 131. The inward-facing surface 131 includes a ridged region with ridges and troughs forming a herringbone pattern similar to the ridged regions 111 of an adjacent main plate 110. The top end plate 120 also includes a ridged region (not shown) on its inward-facing surface. The ridged region of the top end plate 120 also includes a ridged region with ridges and troughs forming a herringbone pattern similar to the ridged regions of an adjacent main plate 110. Main plates 110 may be placed against each other with ridges aligned to that troughs of the main plates 110 form enclosed channels through which fluids flow. Additionally, the bottom end plate 130 may be placed against a main plate 110 so that the ridges of the bottom end plate 130 are aligned with the ridges of the main plate to form enclosed channels, and the top end plate 120 may be placed against a main plate 110 so that the ridges of the top end plate 120 are aligned with the ridges of the main plate 110 to form enclosed channels.

Figure 2:
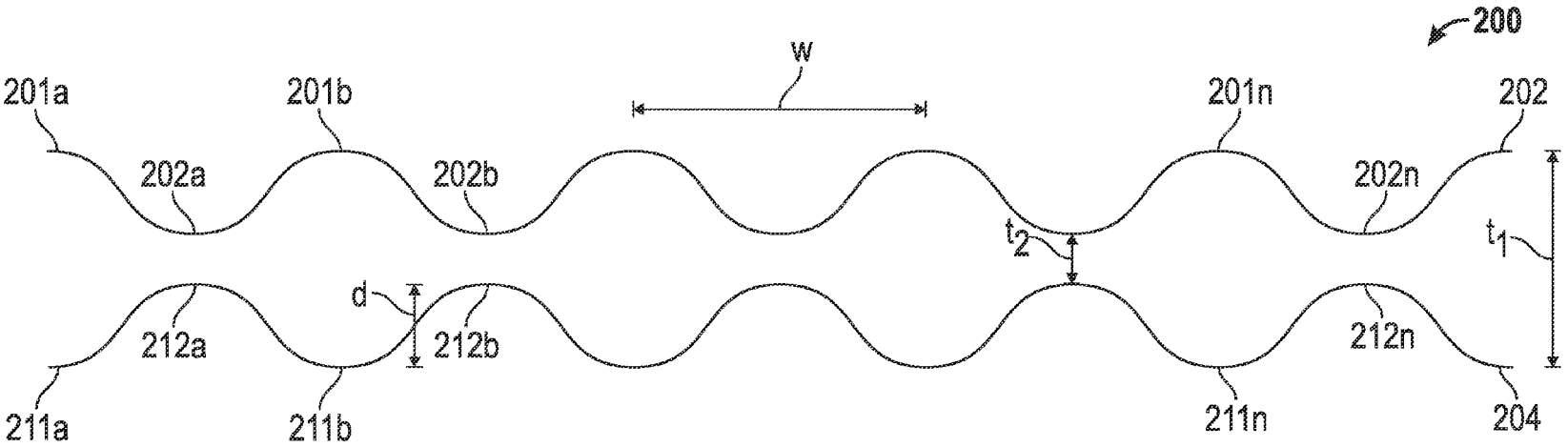
FIG. 2 shows a cross-section of a ridged region of a main plate of the heat exchanger in an exemplary embodiment.

FIG. 2 shows an exemplary cross-section 200 of an exemplary ridged region of a main plate 110 of the heat exchanger 100. The exemplary cross-section 200 shows a first face 202 of the main plate 110 having series of ridges 201*a-n* and troughs 202*a-n*. The cross-section 200 also shows a second face 204 also of the main plate 110 opposite the first face 202. The second face 204 also includes a series of ridges 211*a-n* and troughs 212*a-n*. In an exemplary embodiment, the ridges 201*a-n* and troughs 202*a-n* form a sinusoidal curve and the ridges 211*a-n* and troughs 212*a-n* form a sinusoidal curve. In an exemplary embodiment, the ridges 201*a-n* of the first face 202 are opposite the ridges 211*a-n* of the second face 204, and the troughs 202*a-n* of the first face 202 are opposite the troughs 212*a-n* of the second face 204. In an alternate embodiment, the ridges of the first face 202 may be offset so that the ridges 201*a-n* of the first face 202 are opposite the troughs 212*a-n* of the second face 204, and the troughs 202*a-n* of the first face 202 are opposite the ridges 211*a-n* of the second face 204. The main plate 110 has a thickness t1 equal to about 0.05 inches at the thickest part of the main plate (i.e., the outer thickness), such as between opposing ridges such as ridges 201*n* and 211*n*. The main plate 110 has a thickness t2 equal to about 0.008 inches at the thinnest part of the main plate (i.e., the inner thickness), such as between opposing troughs such as troughs 201*n* and 211*n*. Thus, a height d of the ridges above the troughs is about 0.042 inches. A width w of the trough may be about 0.1 inches.

Figure 3:
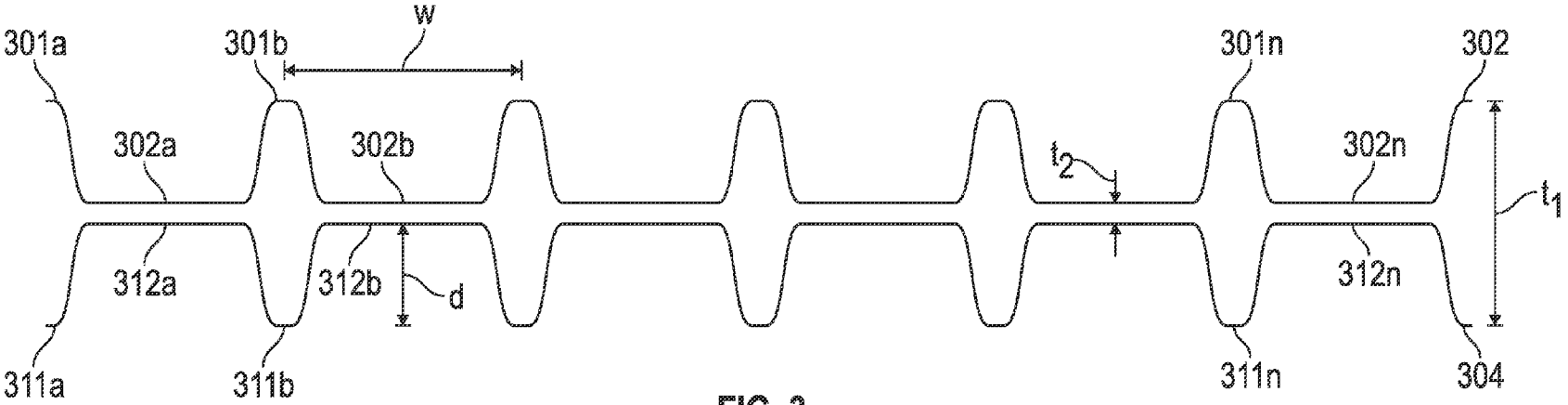
FIG. 3 shows a cross-section of a ridged region of a main plate of the evaporator heat exchanger in an alternate embodiment.

In alternate embodiments, the ridges and troughs may form non-sinusoidal curves or patterns, such as shown in FIG. 3. FIG. 3 shows a main plate 110 that includes a series of ridges 301*a-n* and troughs 302*a-n* along a first face 302 and a series of ridges 311*a-n* and troughs 312*a-n* along a second face 304. The ridges 301*a-n* and 311*a-n* are reduced in width in comparison to the ridges 201*a-n* and 211*a-n* of FIG. 2. Also, the troughs 302*a-n* and 312*a-n* have bottom regions that are extended in length in comparison to the bottom regions of the troughs 202*a-n* and 212*a-n* of FIG. 2. The main plate of FIG. 3 has a thickness t1 equal to about 0.05 inches between opposing ridges such as ridges 301*n* and 311*n* and has a thickness t2 equal to about 0.008 inches between opposing troughs such as troughs 301*n* and 311*n*. Thus, a height d of the ridges above the troughs is about 0.042 inches. A width w of the trough may be about 0.1 inches.

Figure 4:
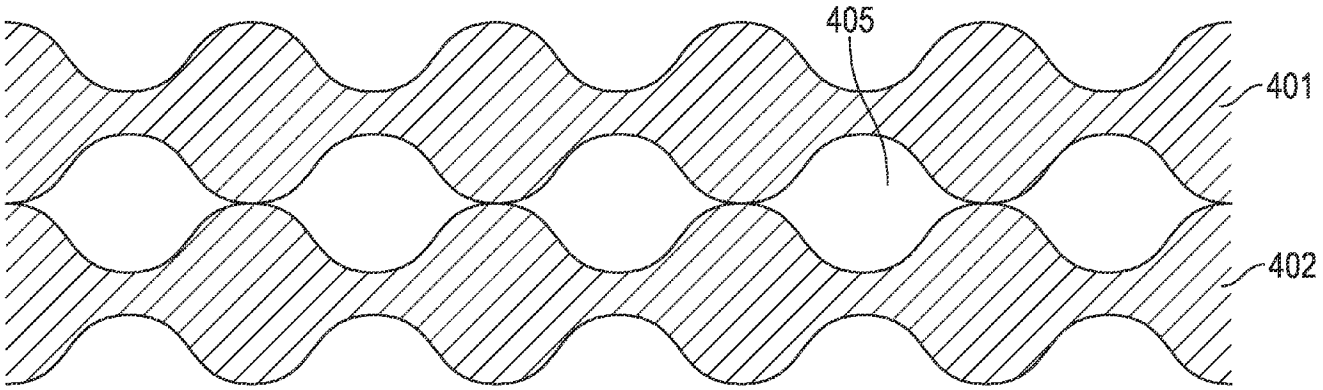
FIGS. 4 and 5 show main plates placed with adjacent faces together.
Figure 5:
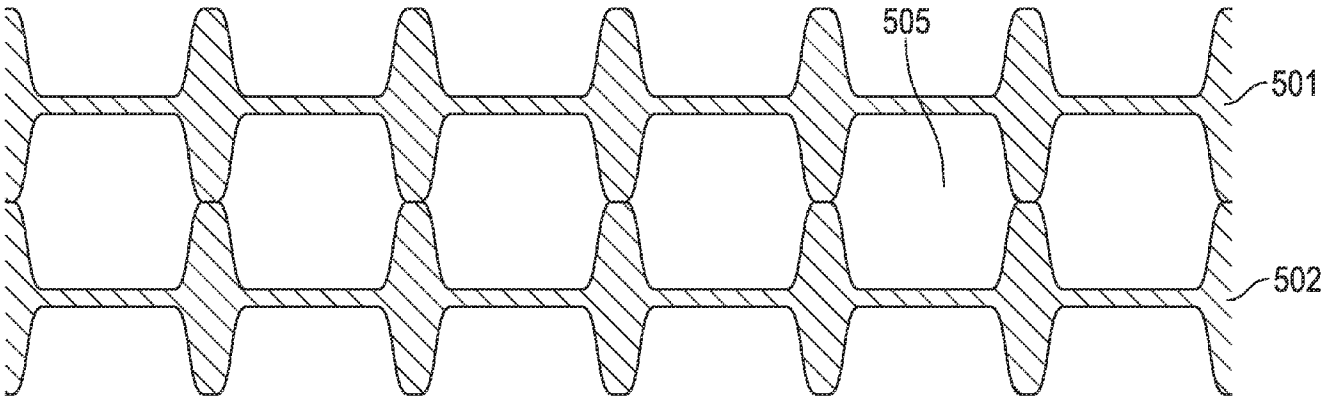

FIGS. 4 and 5 show main plates placed with adjacent faces together. FIG. 4 shows two main plates 401 and 402 of the type shown in FIG. 2 placed adjacent each other. FIG. 5 shows two main plates 501 and 502 of the type shown in FIG. 3 placed adjacent each other. The ridges of the adjacent faces are aligned with each other in order to form enclosed channels 405 and 505. Thus, the enclosed channels have a height of about 0.084 inches and a width of about 0.1 inches. While FIGS. 4 and 5 show adjacent main plates, it is understood that one of the main plates may be replaced by one of the top end plate 120 and the bottom end plate 130 to form the enclosed channel 405 and 505.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated While the exemplary embodiment to the disclosure has been described, it will be understood that those skilled in the art, both now and in the future, may make various improvements and enhancements which fall within the scope of the claims which follow. These claims should be construed to maintain the proper protection for the disclosure first described.

What is claimed is:

1. An evaporator heat exchanger, comprising:

a bottom plate having ridges formed on a face of the bottom plate;

a top plate having ridges formed on a face of the top plate; and a main plate between the bottom plate and the top plate, wherein the main plate includes a first face having ridges formed therein and a second face opposite the first face having ridged formed therein, wherein the main plate is placed between the bottom plate and the top plate so that the ridges of the bottom plate are opposite the ridges of the first face of the main plate to form enclosed channels for flow of a first fluid and the ridges of the second face of the main plate aligns with the ridges of the top plate to form enclosed channels for flow of a second fluid and heat is exchanged between the first fluid and the second fluid through the main plate, wherein ridges of the first face are opposite the ridges of the second face, a thickness between ridges on opposite faces of the main plate is 0.05 inches, a thickness measured between troughs on opposite faces of the main plate is about 0.008 inches and a distance between adjacent ridges on a same face of the main plate is about 0.1 inches.

2. The evaporator heat exchanger of claim 1, wherein at least one of the ridges on the first face and the ridges on the second face form a herringbone pattern.

3. The evaporator heat exchanger of claim 1, wherein a thickness of the main plate measured between ridges on opposite faces of the main plate is about 0.05 inches.

4. The evaporator heat exchanger of claim 1, wherein a thickness of the main plate measured between troughs on opposite faces of the main plate is about 0.008 inches.

5. The evaporator heat exchanger of claim 1, wherein a distance between adjacent ridges on a same face of the main plate is about 0.1 inches.

6. The evaporator heat exchanger of claim 1, wherein at least one of: a trough of the first face coincides with a ridge of the second face; and (ii) the trough of the first face coincides with a trough of the second face.

7. The evaporator heat exchanger of claim 2, wherein the herringbone pattern on the first face is inverted from the herringbone pattern on the second face.

* * * * *